US011691862B2

(12) United States Patent
Poeschl

(10) Patent No.: US 11,691,862 B2
(45) Date of Patent: Jul. 4, 2023

(54) APPARATUS AND METHOD FOR TREATING A CONTAINER WITH FUNCTIONAL CHECKING

(71) Applicant: KRONES AG, Neutraubling (DE)

(72) Inventor: Stefan Poeschl, Neutraubling (DE)

(73) Assignee: KRONES AG, Neutraubling (DE)

( * ) Notice: Subject to any disclaimer, the term of this patent is extended or adjusted under 35 U.S.C. 154(b) by 76 days.

(21) Appl. No.: 17/502,443

(22) Filed: Oct. 15, 2021

(65) Prior Publication Data

US 2022/0119238 A1 Apr. 21, 2022

(30) Foreign Application Priority Data

Oct. 16, 2020 (DE) ..... 10 2020 127 389.4

(51) Int. Cl.

| | |
|---|---|
| ***B67C 3/28*** | (2006.01) |
| ***B67C 3/22*** | (2006.01) |
| ***B67C 3/24*** | (2006.01) |
| ***B67C 3/26*** | (2006.01) |

(52) U.S. Cl.

CPC ..... *B67C 3/287* (2013.01); *B67C 3/225* (2013.01); *B67C 3/24* (2013.01); *B67C 3/26* (2013.01)

(58) Field of Classification Search

CPC ..... B67C 3/24; B67C 3/26; B67C 3/2642; B67C 7/0073; B67C 3/287

USPC ..... 141/90–92

See application file for complete search history.

(56) References Cited

U.S. PATENT DOCUMENTS 5,031,673 A * 7/1991 Clusserath ..... B67C 3/10 141/11
5,501,253 A * 3/1996 Weiss ..... B67C 3/2631 141/49
5,564,481 A * 10/1996 Clusserath ..... B67C 3/10 141/39
7,703,484 B2 4/2010 Montavoci et al.

(Continued)

FOREIGN PATENT DOCUMENTS

DE 10061401 A1 * 6/2002 ..... B67C 3/002
DE 102005035264 B4 4/2018

(Continued)

OTHER PUBLICATIONS

German Search Report dated Jul. 8, 2021 for German Application No. 10 2020 27 389.4, 5 pages.

(Continued)

*Primary Examiner* — Timothy L Maust

(74) *Attorney, Agent, or Firm* — Haynes & Boone, LLP

(57) ABSTRACT

An apparatus for treating a container with a treatment fluid, for example in a beverage bottling plant, including: at least one treatment member with a switchable treatment valve, wherein the treatment member is configured to treat the container with the treatment fluid by opening the treatment valve and to end the treatment by closing the treatment valve; at least one motion sensor which is configured to detect a movement of the treatment member or a component that is mechanically coupled to the treatment member during switching of the treatment valve; and an electronic evaluation unit which is coupled in a communicating manner to the motion sensor and is configured to draw conclusions about the switching behavior of the treatment valve from processing the data that is detected by the motion sensor.

20 Claims, 3 Drawing Sheets

(56) References Cited

U.S. PATENT DOCUMENTS

| | | | | |
|---|---|---|---|---|
| 10,603,834 | B2 | 3/2020 | Gillet | |
| 11,325,817 | B2 * | 5/2022 | Staeber | B65B 31/08 |
| 2022/0289546 | A1 * | 9/2022 | Krulitsch | B67C 3/2614 |

FOREIGN PATENT DOCUMENTS

| | | | | |
|---|---|---|---|---|
| DE | 10 2017 120 295 | A1 | 3/2019 | |
| DE | 102019104387 | A1 | 8/2020 | |
| DE | 10 2019 118 982 | A1 | 1/2021 | |
| EP | 3984657 | A1 * | 4/2022 | B67C 3/002 |
| JP | 06048487 | A | 2/1994 | |
| WO | WO 2019/121151 | A1 | 6/2019 | |

OTHER PUBLICATIONS

Extended European Search Report for EP Application No. 21 203 097.7 dated Mar. 17, 2022; 5 pages.

* cited by examiner

APPARATUS AND METHOD FOR TREATING A CONTAINER WITH FUNCTIONAL CHECKING

CROSS-REFERENCE TO RELATED APPLICATIONS

This application claims priority from German Patent Application No. DE 10 2020 127 389.4, filed on Oct. 16, 2020 in the German Patent and Trademark Office, the disclosure of which is incorporated herein by reference in its entirety.

BACKGROUND

Technical Field

The present invention relates to an apparatus and to a method for treating a container with a treatment fluid, in particular for filling a container with a filling product in a beverage bottling plant.

Related Art

Filling members of different types are known for bottling filling products, for example beverages in a beverage bottling plant. Throughflow of the filling product through the filling member and consequently introduction into a container is generally controlled by a filling valve which comprises a valve cone which sits in a valve receptacle that is of complementary shape to the valve cone. The filling process is started by way of lifting the valve cone out of the valve receptacle or out of the valve seat, and the filling process is ended again by way of subsequently lowering the valve cone onto the valve seat.

It is known to operate the filling valve of a filling member by a pneumatic system which, in turn, is driven electronically. Delays, which for example depend on the condition of the valve and are difficult to predict, may occur between electronic driving and switching of the valve. In addition, malfunctions may occur. This also applies to actuators of other functional types, for example for electromotive or magnetic driving of the valve, and to valves which are used in other areas of container treatment or the packaging industry, such as for example in blow-moulding machines for expanding a preform to form a container that is to be filled.

Measuring and monitoring switching and any delays in switching of a valve in a filling member or another container treatment member require a great deal of mechanical effort since a large number of functions have to be monitored between electronic driving and mechanical conversion at the valve. Since, in addition, a large number of container treatment members are normally installed in a plant, for example up to 200 filling members in one filler, complete monitoring by sensors would be extremely complicated and require maintenance and be susceptible to faults. Therefore, at present, it is very difficult, for example in the course of predictive maintenance, to check and to monitor functioning of the valve, such as for example pneumatic functioning, in detail.

SUMMARY

An improved apparatus and an improved method for treating a container with a treatment fluid, in particular to improve the reliability is described herein according to various embodiments.

The apparatus serves to treat a container with a treatment fluid. The apparatus is particularly, in certain embodiments, used in a beverage bottling plant, for example for bottling water, beer, juice, soft drinks, smoothies, milk products and the like. However, the principle can also be used in other apparatuses or parts of a plant, in particular of a beverage bottling plant, for example in a blow-moulding apparatus for expanding a preform to form a container.

The apparatus has at least one treatment member with a switchable treatment valve, wherein the treatment member is configured to treat the container with the treatment fluid by opening the treatment valve and to end the treatment by closing the treatment valve. The term "treat" may comprise, for example, filling the container, rinsing, cleaning, expanding or the like.

The apparatus has at least one motion sensor which is configured to detect a movement of the treatment member or a component that is mechanically coupled to the treatment member during switching of the treatment valve. The apparatus further has an electronic evaluation unit which is coupled in a communicating manner to the motion sensor. The coupling can be implemented in a wireless or wired fashion and serves for data interchange, in one embodiment, in both directions but at least from the motion sensor to the evaluation unit. The evaluation unit is configured to draw conclusions about the switching behaviour of the treatment valve from processing the data that is detected by the motion sensor.

Although the motion sensor can by all means directly detect the movement of a movable valve part of the treatment valve, such as for example a valve cone, the movement here in one embodiment comprises indirect movements of the treatment member and/or associated components, these movements originating from operation of the treatment valve. Therefore, for example, characteristic vibrations are produced during closing of the treatment valve and these can be used and evaluated for evaluating the response behaviour of the treatment valve, for example for ascertaining a dead time between a switching signal for operating the treatment valve and the functioning of the said treatment valve.

Monitoring the response behaviour of the treatment valve can be implemented in a mechanically simple manner, as a result of which existing apparatuses can accordingly be upgraded in a simple manner. Therefore, correct progress of the treatment can be monitored and therefore the reliability can be increased using few resources and at low cost. Even complex movements can be checked and monitored owing to algorithmic evaluation of the data from the motion sensor with minimal sensor complexity.

In addition, the apparatus in one embodiment has: an actuator which is configured to operate the treatment valve, and an electronic control device which is can be coupled in a communicating manner to the evaluation unit and is configured to control the actuator in a signal-based manner. The control device comprises electronic components, such as for example a circuit board with a processor, a memory, a communication device etc., to control the functioning of the treatment member.

The motion sensor, in one embodiment, is integrated in the control device or fitted thereto, for example directly in the electronics system, on the circuit board or the like. Therefore, the treatment member can be equipped with the monitoring function for the response behaviour in a structurally simple manner, without the treatment member itself having to be significantly structurally modified.

The actuator, in one embodiment, operates pneumatically, i.e. it may comprise a pneumatic cylinder with a piston which, for operating the treatment valve, is mechanically connected to a movable part thereof, for example to a valve cone. However, as an alternative, the actuator can also be constructed in a different way, for example can operate hydraulically, magnetically or electromotively.

Processing the data that is detected by the motion sensor using the evaluation unit in one embodiment comprises ascertaining a dead time between a switching signal to the actuator and operation of the treatment valve. The terms "operating" and "switching" each comprise, in particular, opening and/or closing the treatment valve. However, operating and switching can also be implemented by way of the treatment valve being moved to an intermediate position. All of these forms of operation lead to minimal, yet characteristic, movements of the treatment member or components that are mechanically coupled thereto, which movements can be detected by the motion sensor and used for evaluation. Here, the dead time, derivable therefrom, is a parameter that is comparatively simple to determine, and provides information about any deviations in the response behaviour from a standard behaviour.

The evaluation unit, in one embodiment is configured to algorithmically process the data that is detected by the motion sensor, in particular by means of one or more self-learning algorithms, in order to identify deviations in the switching behaviour of the treatment valve from the standard behaviour. Anomalies in the operation of the treatment valve can be algorithmically identified using the data that is collected by the evaluation unit. For example, in the simplest case, ascertained dead times can be compared with one another in order to identify malfunctions or changes in the response behaviour of the treatment valve at an early stage and possibly take measures, such as for example maintenance, replacement or the like. Deviations in the treatment valve from the standard behaviour can be identified at an early stage by means of more complicated processing of the data, for example by using so-called artificial intelligence or so-called self-learning algorithms, as a result of which any imminent malfunction, a defect or the like can be predicted ("Predictive Maintenance").

The principle is particularly, for example, used in an apparatus for filling a container with a filling product, in particular a beverage. In this case, the treatment member is a filling member with a product outlet which is configured to dispense the filling product into a container that is located therebeneath. The treatment valve is a filling valve here.

The filling member, in one embodiment, has a product duct that is fluidically connected to the product outlet, and the filling valve has a valve cone that is arranged in the product duct, a valve seat that is of complementary shape at least in sections, and an actuator which is configured to shift the valve cone along an axial direction of the product outlet or product duct, so that the valve cone can be moved into the valve seat for the purpose of blocking the product outlet and can be moved out of the said valve seat for the purpose of opening the product outlet.

The filling valve can be designed as a shut-off valve, so that it can be switched in a binary manner between a closed and an open state. As an alternative, the filling valve can be equipped with a throughflow regulation arrangement, so that, in addition to the closed state, several open states with different rates of volume throughflow can be set. In this case, the filling valve can be regulated discretely or continuously.

The abovementioned throughflow regulation can be implemented, for example, by way of the valve cone having a cylindrical shape that tapers in the direction of the product outlet. The product duct, which is in the shape of an annular duct in the region of the valve cone, is formed on the inside at least in sections by the outer circumferential surface of the valve cone. On the outside, the annular gap is delimited or formed by a valve housing. According to this embodiment, the valve cone is configured such that it can be shifted in the axial direction, i.e. upwards and downwards. The annular gap at the product outlet can be increased in size and reduced in size in this way. The vertical adjustment of the valve cone takes place within a working region, i.e. between a fully open position and a closed position or a position of minimal throughflow, for example in a stepless manner.

At least one of the motion sensors, in one embodiment, is integrated in the valve cone and/or actuator or fitted thereto. As an alternative or in addition, at least one of the motion sensors can be integrated in the valve housing or fitted thereto. The positions mentioned here for mounting a motion sensor allow the filling member to be equipped with one or more motion sensors in a mechanically simple manner. If a throughflow meter, which can be used for metering the filling product on the basis of the measured volumetric or mass flow rate, is provided, a motion sensor can then also be integrated therein or fitted thereto.

The apparatus, in one embodiment, has at least one container holder for receiving, holding and/or stabilizing the container that is to be filled. In this case, the motion sensor or at least one motion sensor is integrated in the container holder or fitted thereto. In this case, mechanical modification of the filling member can be substantially dispensed with, and the motion sensor is mounted at a point which may be easier to access and service. For example, the motion sensor can be fitted, for example, on a lifting cylinder of the container holder.

However, the principle may also be useful in other apparatuses, for example in an apparatus for producing a container from a preform. In this case, the treatment member is, for example, an expansion member which is configured to produce the container from a preform by applying an expansion gas to the said preform.

In this case, the motion sensor or at least one motion sensor, in one embodiment, is integrated in a container holder for holding the preform and the container that is produced from it, or is fitted thereto.

Precisely one motion sensor, in one embodiment, is provided for each treatment member. The monitoring functions can be achieved with very little sensor complexity. This involves an important technical contribution to indirect motion detection and electronic evaluation of the same.

The motion sensor, in one embodiment, is an acceleration sensor. An acceleration sensor can autonomously, i.e. in particular without position comparison relative to a stationary component, detect the movements of the treatment member or of the corresponding components that are mechanically coupled thereto and is in this respect mechanically particularly simple to implement.

The motion sensor ascertains a movement/acceleration at least along one spatial axis. However, the motion sensor can also be configured to detect movements/accelerations along two or three independent spatial axes. For this purpose, a plurality of motion sensors can also be provided.

A method for treating a container with a treatment fluid, for example in a beverage bottling plant is also described herein according to various embodiments. The method comprises: switching, for example opening or closing, a treatment valve of a treatment member in order to treat the container with the treatment fluid or to end the treatment; detecting a movement of the treatment member or a component that is mechanically coupled to the treatment member, which movement is caused by switching the treatment valve, by means of a motion sensor which, in one embodiment, is an acceleration sensor; and processing the data that is detected by the motion sensor by means of an electronic evaluation unit which is coupled in a communicating manner to the motion sensor in order to draw conclusions about the switching behaviour of the treatment valve.

The features, technical effects, advantages and exemplary embodiments which have been described with reference to the apparatus likewise apply to the method.

For example, for the abovementioned reasons, the treatment valve, in one embodiment, is operated by means of an actuator, in particular pneumatically, hydraulically, magnetically or electromotively, wherein the actuator is in this case controlled in a signal-based manner by means of an electronic control device which, in one embodiment, is coupled in a communicating manner to the evaluation unit. Processing the data that is detected by the motion sensor using the evaluation unit comprises, in one embodiment, ascertaining a dead time between a switching signal to the actuator and operation of the treatment valve.

The method is, in one embodiment, used for bottling a filling product, for example a beverage. In this case, the treatment member is a filling member with a product outlet which dispenses the filling product for treatment purposes into a container that is located therebeneath, and the treatment valve is a filling valve.

The filling member, in one embodiment, has a product duct that is fluidically connected to the product outlet, wherein the filling valve has a valve cone that is arranged in the product duct, a valve seat that is of complementary shape at least in sections, and an actuator which is configured to shift the valve cone along an axial direction of the product outlet or product duct, so that the valve cone can be moved into the valve seat for the purpose of blocking the product outlet and can be moved out of the said valve seat for the purpose of opening the product outlet.

For the abovementioned reasons, the movement of the valve cone and/or actuator and/or a valve housing of the filling member and/or a container holder for receiving, holding and/or stabilizing the container that is to be filled is, in one embodiment, detected by one or more motion sensors.

Further advantages and features of the present invention are apparent from the following description of exemplary embodiments. The features described therein can be implemented alone or in combination with one or more of the features outlined above, provided that the features are not contradictory. The following description of exemplary embodiments is given with reference to the accompanying drawings.

BRIEF DESCRIPTION OF THE FIGURES

Further embodiments of the invention are explained in more detail by the following description of the figures.

DETAILED DESCRIPTION

Exemplary embodiments are described below with reference to the figures. In so doing, elements which are the same, are similar or act in the same way are provided with identical reference signs in the various figures, and repeated description of the said elements is dispensed with in parts in order to avoid redundancies.

Figure 1:
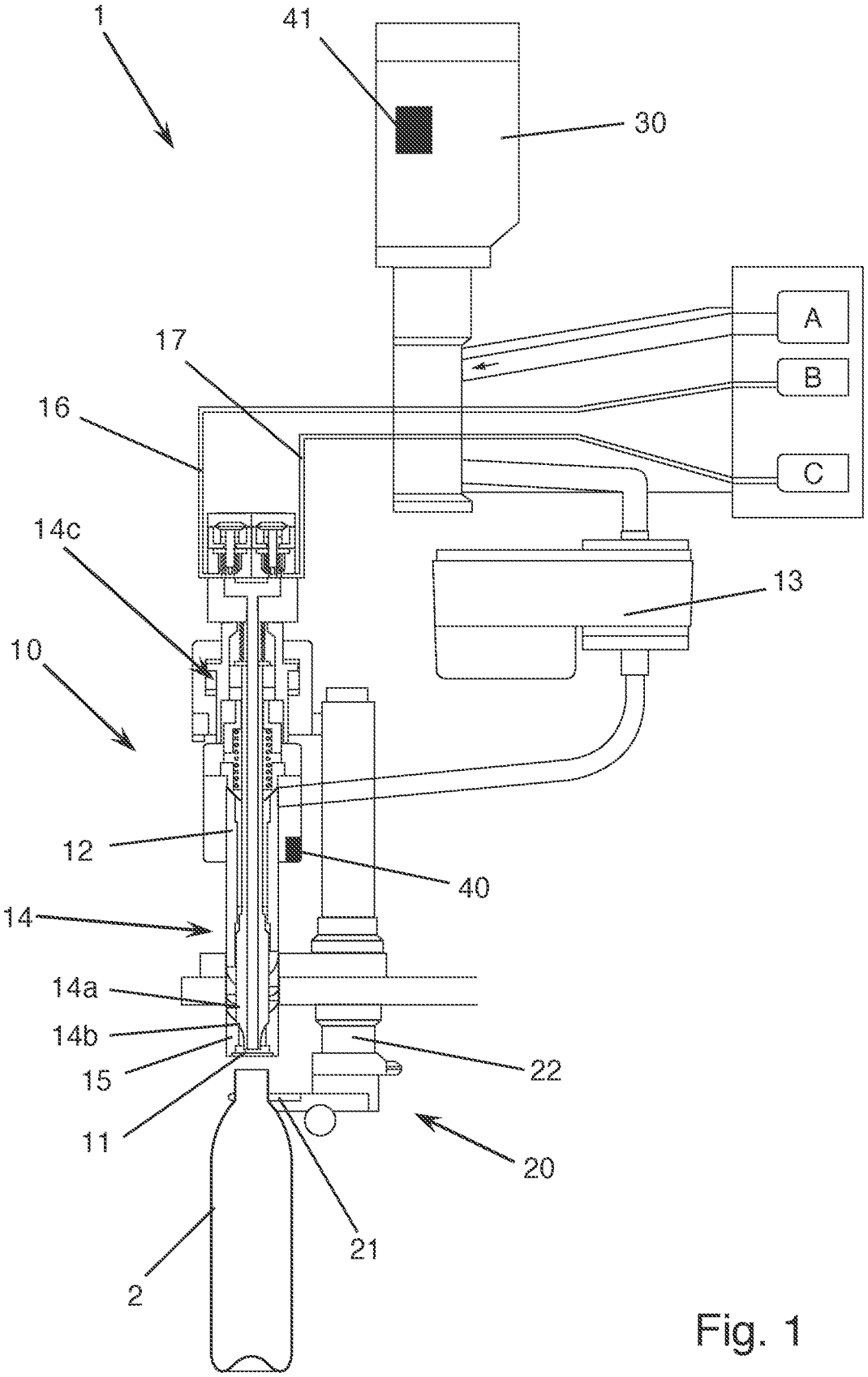
FIG. 1 shows a schematic view of a filling member for filling a filling product into a container with a motion sensor that is fitted to the filling member.

FIG. 1 is a schematic view of an apparatus 1 for treating a container 2, here specifically for filling the container 2 with a filling product. The apparatus 1 is, in one embodiment, used in a beverage bottling plant, for example for bottling water (still or carbonated), soft drinks, beer, milk products, juices, smoothies or the like.

The apparatus 1 has at least one treatment member 10, which is a filling member in the present exemplary embodiment. The filling member 10 is configured to fill a container 2 located therebeneath with the filling product.

A plurality of filling members 10, in one embodiment, are provided, these being arranged, for example, on the periphery of a carousel (not shown in the figures) in order to be able to produce a continuous flow of filled containers on the carousel. Accordingly, the apparatus 1, in one embodiment, is configured with a carousel-like construction.

The filling member 10 is configured for example for free-flow filling in which the filling product, generally at atmospheric pressure, flows in free fall, that is to say not influenced by any guide apparatuses, into the container 2 that is to be filled. In this case, the filling product may be made to swirl by swirl bodies and/or corresponding shaping of a product outlet 11, so that the said filling product flows downward with a spiral movement on the container wall under the action of centrifugal force. Any gas that is located in the container and is displaced by the filling product during filling can escape centrally through the container mouth. Uniform, smooth and problem-free bottling with short filling times can be implemented in this way.

As an alternative, the filling member 10 can be configured for pressure-tight connection to the container 2 during the filling process, in particular for abrupt filling. In the case of abrupt filling, the filling product is provided at positive pressure, the container 2 that is to be filled is evacuated and the filling product that is at positive pressure is introduced into the container 2 that is at negative pressure. On account of the pressure difference produced in this way, the filling product is introduced abruptly.

However, the filling member 10 can also have a different design, provided that it comprises a filling valve 14, the switching behaviour of which is intended to be monitored, as is outlined in detail further below.

The filling member 10 according to the present exemplary embodiment has a product duct 12 which is fluidically connected to the product outlet 11. The product duct 12 is supplied with filling product, for example, from a filling product reservoir (not shown in the figures) that is situated upstream of the filling member 10. In the exemplary embodiment of FIG. 1, a throughflow meter 13, which can be used for metering the filling product on the basis of the measured volumetric or mass flow rate, is located in the product duct 12.

The treatment member 10 further has a treatment valve 14, in the present exemplary embodiment a filling valve, which comprises a valve cone **14*a* and a valve seat 14*b* that is of complementary shape at least in sections. The filling valve 14 further has an actuator 14*c* or is mechanically coupled to such an actuator which can shift the valve cone 14*a* along an axial direction, so that the valve cone 14*a* can be moved into the valve seat 14*b* for the purpose of blocking the product duct 12 or product outlet 11 and thereby interrupting the throughflow and can be moved out of the said valve seat for the purpose of opening the product duct 12 or product outlet 11**.

The actuator 14*c* can comprise means for electromotively, magnetically, hydraulically and/or pneumatically operating the valve cone 14*a*. The actuator 14*c*, in one embodiment, operates the valve cone 14*a* pneumatically. In addition, the actuator can have a spring or the like in order to preload the valve cone 14*a* into a working position, for example the closed or fully open position.

The filling valve 14 can be designed as a shut-off valve, so that it can be switched in a binary manner between a closed and an open state. As an alternative, the filling valve 14 can be equipped with a throughflow regulation arrangement, so that, in addition to the closed state, several open states with different rates of volume throughflow can be set. In this case, the filling valve 14 can be regulated discretely or continuously.

The abovementioned throughflow regulation can be implemented, for example, by way of the valve cone 14*a* having a cylindrical shape that tapers in the direction of the product outlet 11. The product duct 12, which is in the shape of an annular duct in the region of the valve cone 14*a*, is formed on the inside at least in sections by the outer circumferential surface of the valve cone 14*a*. On the outside, the annular gap is delimited or formed by a valve housing 15. According to the present exemplary embodiment, the valve cone 14*a* is configured such that it can be shifted in the axial direction, i.e. upwards and downwards. The annular gap at the product outlet 11 can be increased in size and reduced in size in this way. The vertical adjustment of the valve cone 14*a* takes place within a working region, i.e. between a fully open position and a closed position or a position of minimal throughflow, for example in a stepless manner.

According to the exemplary embodiment of FIG. 1, the filling member 10 is further equipped with a pressure and/or gas duct 16 and a CIP duct 17.

The pressure and/or gas duct 16 can be configured to establish a positive or negative pressure in the interior of the container 2 and/or to rinse the container with a gas, for example for preloading the container, and/or to dissipate any gas which is displaced during filling.

The CIP duct 17 is part of a CIP device. Here, the term "CIP" stands for "Cleaning-In-Place", a cleaning process in which the filling member 10 does not have to be removed for cleaning purposes but rather can be flushed or steam-treated with a cleaning medium in the installed state. For reasons of linguistic simplicity, the term "CIP" in this document also comprises so-called "Sterilizing-In-Place" (SIP), a sterilizing process in which the filling member 10 likewise does not have to be removed for sterilization purposes but rather can be flushed or steam-treated with a sterilizing medium in the installed state.

The apparatus 1 further comprises one or more container holders 20 for receiving, holding and/or stabilizing the container 2 that is to be filled. The container holders 20 can be provided independently of the filling members 10, can be respectively associated with them or accordingly can form part of the filling members 10. In the exemplary embodiment of FIG. 1, the container holder 20 is fitted to the filling member 10 and can in this respect be considered a constituent part of the said filling member.

The container holder 20 can be configured in a suitable manner depending on the shape of the container, the treatment process etc. In the exemplary embodiment of FIG. 1, the container holder 20 is configured for bottles and for this purpose has a receptacle 21 which is configured to grip or clasp the neck of the bottle or the mouth portion of the container 2 in a clamp-like manner. The receptacle 21 can be fitted to a lifting cylinder 22 in order to lift the container 2 in the direction of the product outlet 11 for filling, possibly to push the said container against the filling member 10, and to lower the said container for removal of the container 2 at the end of filling.

The apparatus 1 further comprises a control device 30 which is configured to electronically control the functioning of the filling member 10 or a plurality of filling members 10. The control device 30 can be provided independently of the filling member 10, can be associated with it or accordingly can form part of the filling member 10. The control device 30 comprises electronic components, such as for example a circuit board with a processor, a memory, a communication device etc., to control the functioning of the filling member 10. In particular, the control device 30 serves to drive the actuator 14*c*, i.e. to set the time and duration of operation, stroke of the valve cone 14*a* and the like. The control device 30 can operate autonomously or can be incorporated into a network. For example, the control device 30 can communicate with a superordinate process regulation arrangement (not shown in the figures).

The apparatus 1 comprises at least one motion sensor 40 which is fitted to the filling member 10 or integrated therein in the exemplary embodiment of FIG. 1.

Upon operation of the filling valve 14, for example upon preloading, opening, closing, load-relief etc., the filling member 10 and components that are mechanically coupled thereto execute small relative movements which can be picked up by the sensor. The motion sensor 40 is designed to detect such movements. For example, the dead time between a switching signal for operating the filling valve 14 and the functioning of the actuator 14*c*, for example pneumatic functioning, can be ascertained in this way.

Although the motion sensor 40 can by all means directly detect the movement of the valve cone 14*a*, the movement here, in one embodiment, comprises indirect movements of the filling member 10 and/or associated components, these movements originating from the operation of the filling valve 14. Therefore, for example, characteristic vibrations are produced during closing of the filling valve 14 and these can be used and evaluated for evaluating the response behaviour of the filling valve 14.

For this purpose, the motion sensor 40, in one embodiment, is an acceleration sensor. An acceleration sensor can detect the movements without position comparison relative to a stationary component and is in this respect mechanically particularly simple to implement. The motion sensor 40 ascertains a movement/acceleration at least along one spatial axis. However, the motion sensor 40 can also be configured to detect movements/accelerations along two or three independent spatial axes. For this purpose, a plurality of motion sensors 40 can also be provided.

In the exemplary embodiment of FIG. 1, the motion sensor 40 is integrated in the valve housing 15 or fitted thereto.

Figure 2:
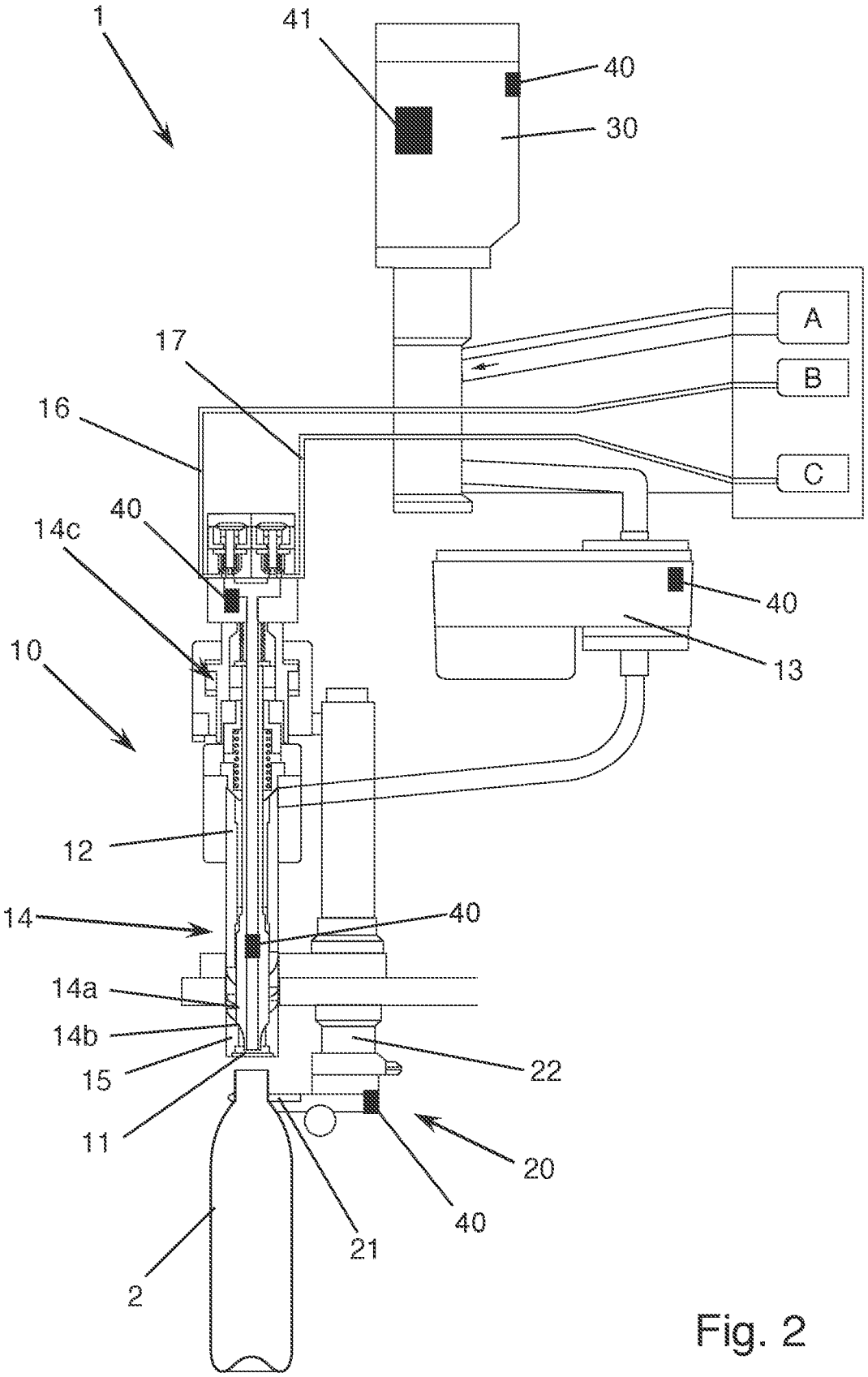
FIG. 2 shows a schematic view of a filling member for filling a filling product into a container with a motion sensor that is provided in alternative positions.

FIG. 2 shows the apparatus according to FIG. 1, but with alternative or additional positions for mounting one or more motion sensors 40.

A motion sensor 40 can be integrated in the control device 30, for example directly in the electronics system, on the circuit board or the like. Therefore, the filling member 10 can be equipped with the function for dead time detection in a structurally simple manner, without the filling member 10 itself having to be significantly structurally modified.

As an alternative or in addition, a motion sensor 40 can be fitted in or to the throughflow meter 13 and/or valve cone 14*a* and/or actuator 14*c* and/or the container holder 20, for example to the lifting cylinder 22.

The motion sensor 40 is coupled in a communicating manner, in a wireless or wired fashion, to an evaluation unit 41 which is configured to process the data from the one or the plurality of motion sensors 40. The evaluation unit 41 can be a constituent part of the control device 30 or else can be provided separately therefrom. The evaluation unit 41 and the control device 30, in one embodiment, are coupled in a communicating manner, for example for ascertaining the dead times mentioned.

Anomalies in the operation of the filling valve 14 can be algorithmically identified using the data that is collected by the evaluation unit 41. For example, in the simplest case, ascertained dead times can be compared with one another in order to identify malfunctions or changes in the response behaviour of the filling valve 14 and possibly take measures, such as for example maintenance, replacement or the like. The data obtained by the motion sensor 40 can be algorithmically evaluated, for example by means of so-called artificial intelligence or self-learning algorithms. In this way, deviations in the filling valve 14 from the standard behaviour can be identified at an early stage, as a result of which any imminent malfunction, a defect or the like can be predicted ("Predictive Maintenance").

Monitoring the response behaviour of the filling valve 14 can be implemented in a mechanically simple manner, as a result of which existing apparatuses 1 can accordingly be upgraded in a simple manner. Therefore, correct progress of filling can be monitored using few resources and at low cost. Even complex movements can be checked and monitored owing to algorithmic evaluation of the data from the motion sensor 40 with minimal sensor complexity.

The functionality outlined in this document can likewise also be implemented in other apparatuses, in particular apparatuses or plant parts of a beverage bottling plant.

Figure 3:
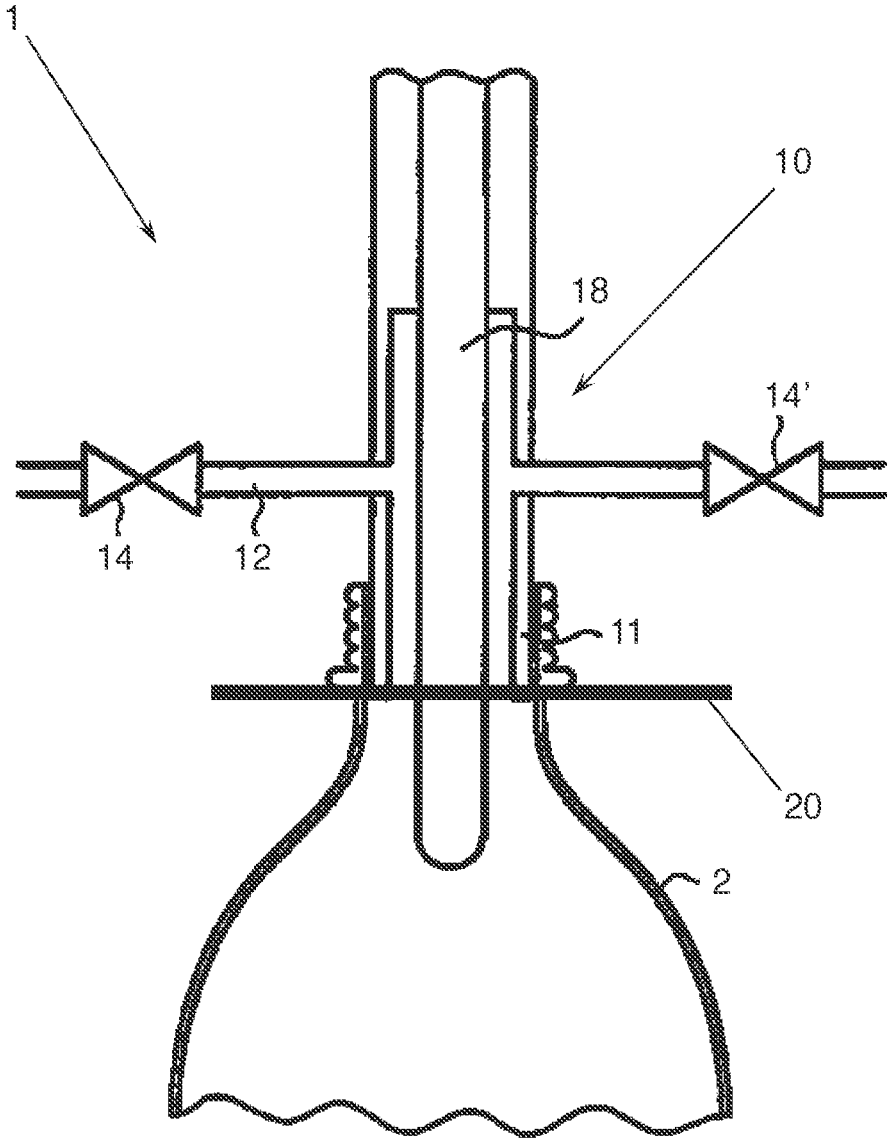
FIG. 3 shows a schematic view of a detail of a blow-moulding apparatus for expanding a preform to form a container.

By way of example, FIG. 3 shows a detail of an apparatus 1 which is provided as a blow-moulding apparatus for expanding a preform. For this purpose, the preform that is to be expanded is connected to a treatment member 10 which has a product outlet 11 that is formed as a blow-moulding nozzle. The preform can have, at its top end, a thread and a supporting ring. The preform is placed on the blow-moulding nozzle and connected to it in a pressure-tight manner. The blow-moulding nozzle can have a stretching rod 18 which is used in the blow-moulding process. The preform is then expanded to form a container 2 which is, for example, a polyethylene terephthalate (PET) bottle.

FIG. 3 shows a state in which blow-moulding of the container 2 from a preform has already taken place. The multipartite blow mould itself, which surrounds the container 2 and determines its final shape, is not shown in FIG. 3. It should be noted that the terms "preform" and "container" are interchangeable since they merely represent different stages of production. The preform or container 2 is held by a container holder 20 during expansion.

An expansion medium, which is a gas at a temperature in the range of between 80° C. and 140° C. in one embodiment, is used in order to expand the preform. A product duct 12 leads from a pressure source, not shown in FIG. 3, for example a compressor, to the blow-moulding nozzle. The product duct 12 can be shut off by a treatment valve 14.

The blow-moulding nozzle is further connected to a pressure medium discharge path which can be shut off by a discharge valve 14'.

According to the exemplary embodiment of FIG. 3, the container holder 20 is equipped with a motion sensor 40, as a result of which the response behaviour of the treatment valve 14 and/or of the shut-off valve 14' can be monitored.

For example, the blow-moulding apparatus according to FIG. 3 comprises an evaluation unit, similarly to the exemplary embodiments of FIGS. 1 and 2, even though this is not explicitly shown in FIG. 3. Equally, not only the features but also advantages, technical contributions and the like that have been described with reference to FIGS. 1 and 2 likewise apply to the exemplary embodiment of FIG. 3.

Where applicable, all the individual features which are illustrated in the exemplary embodiments can be combined with one another and/or exchanged for one another, without departing from the scope of the invention.

What is claimed is:

1. An apparatus for treating a container with a treatment fluid, comprising:

at least one treatment member with a switchable treatment valve, wherein the at least one treatment member is configured to treat the container with the treatment fluid by opening the switchable treatment valve and to end treatment by closing the switchable treatment valve;

at least one motion sensor configured to detect a movement of the at least one treatment member or of a component that is mechanically coupled to the at least one treatment member during switching of the switchable treatment valve; and an electronic evaluation unit coupled in a communicating manner to the at least one motion sensor, and configured to draw conclusions about a switching behavior of the switchable treatment valve from processing data that is detected by the at least one motion sensor.

2. The apparatus of claim 1, further comprising:

an actuator configured to operate the switchable treatment valve; and an electronic control device configured to control the actuator in a signal-based manner.

3. The apparatus of claim 2, wherein the actuator is configured to operate the switchable treatment valve pneumatically, hydraulically, magnetically or electromotively.

4. The apparatus of claim 2, wherein the electronic control device is coupled in a communicating manner to the electronic evaluation unit, and the at least one motion sensor is integrated in the electronic control device or fitted thereto.

5. The apparatus of claim 2, wherein processing data that is detected by the at least one motion sensor comprises ascertaining a dead time between a switching signal from the electronic control device to the actuator and operation of the switchable treatment valve.

6. The apparatus of claim 2, wherein the electronic evaluation unit is configured to algorithmically process the data that is detected by the at least one motion sensor to identify deviations in the switching behavior of the switchable treatment valve from a standard behavior.

7. The apparatus of claim 2, wherein the electronic evaluation unit is configured to algorithmically process the data that is detected by the at least one motion sensor via one or more self-learning algorithms.

8. The apparatus of claim 1, wherein the treatment fluid comprises a filling product, the at least one treatment member comprises a filling member with a product outlet that is configured to dispense the filling product into the container that is located therebeneath, and the switchable treatment valve comprises a filling valve.

9. The apparatus of claim 8, wherein:

the filling member comprises a product duct that is fluidically connected to the product outlet, and the filling valve comprises:

a valve cone that is arranged in the product duct, a valve seat that is of complementary shape to the valve cone at least in sections, and an actuator configured to shift the valve cone along an axial direction of the product outlet that enable the valve cone to be moved into the valve seat to block the product outlet and to be moved out of the valve seat to open the product outlet, and the at least one motion sensor is integrated in the valve cone and/or the actuator or fitted thereto.

10. The apparatus of claim 8, wherein the filling member comprises a valve housing and the at least one motion sensor is integrated into the valve housing or fitted thereto.

11. The apparatus of claim 8, further comprising at least one container holder configured to receive, hold, and/or stabilize the container, wherein the at least one motion sensor is integrated in the at least one container holder or fitted thereto.

12. The apparatus of claim 1, wherein the treatment fluid comprises an expansion gas, the treatment member comprises an expansion member configured to produce the container from a preform by applying the expansion gas, and the at least one motion sensor is integrated in a container holder configured to hold the preform and the container that is produced from it, or is fitted thereto.

13. The apparatus of claim 1, wherein the at least one treatment member comprises a plurality of treatment members, the at least one motion sensor comprises a plurality of motion sensors, and a single motion sensor is associated with each treatment member.

14. The apparatus of claim 1, wherein the at least one motion sensor comprises an acceleration sensor.

15. A method for treating a container with a treatment fluid, comprising:

switching a treatment valve of a treatment member to treat the container with the treatment fluid or to end treatment;

detecting, via a motion sensor, a movement of the treatment member or of a component that is mechanically coupled to the treatment member, wherein the movement is caused by switching the treatment valve; and processing data that is detected by the motion sensor via an electronic evaluation unit that is coupled in a communicating manner to the motion sensor to draw conclusions about a switching behavior of the treatment valve.

16. The method of claim 15, wherein the switching comprises opening or closing the treatment valve, and the motion sensor comprises an acceleration sensor.

17. The method of claim 15, wherein:

the treatment valve is operated by an actuator, and the actuator is controlled in a signal-based manner by an electronic control device that is coupled in a communicating manner to the electronic evaluation unit; and processing the data that is detected by the motion sensor comprises ascertaining a dead time between a switching signal from the electronic control device to the actuator and operation of the treatment valve.

18. The method of claim 15, wherein:

the treatment fluid comprises a filling product, the treatment member comprises a filling member with a product outlet that is configured to dispense the filling product for treatment purposes into the container located therebeneath, the treatment valve comprises a filling valve, the filling member comprises a product duct that is fluidically connected to the product outlet, and the filling valve comprises:

a valve cone that is arranged in the product duct, a valve seat that is of complementary shape to the valve cone at least in sections, and an actuator configured to shift the valve cone along an axial direction of the product outlet that enables the valve cone to move into the valve seat to block the product outlet and move out of the valve seat to open the product outlet.

19. The method of claim 18, wherein movement of the valve cone and/or the actuator is detected by one or more motion sensors.

20. The method of claim 18, wherein movement of a valve housing of the filling member and/or a container holder configured to receive, hold, and/or stabilize the container to be filled is detected by one or more motion sensors.

* * * * *